United States Patent [19]

Beauregard

[11] Patent Number: 4,715,067

[45] Date of Patent: Dec. 29, 1987

[54] GOAL-KEEPER PAD

[75] Inventor: Robert Beauregard, St. Adolphe Dudswell, Canada

[73] Assignees: Roch Fortin, part interest to each; Pierre Nizet, both of Quebec, Canada; part interest to each

[21] Appl. No.: 39,074

[22] Filed: Apr. 16, 1987

[51] Int. Cl.[4] ..... A41D 13/00

[52] U.S. Cl. ..... 2/22; 2/24

[58] Field of Search ..... 2/22, 2, 2.5, 24, 16; 128/80 R, 80 H, 153, 165, 166

[56] References Cited

U.S. PATENT DOCUMENTS

| | | | |
|---|---|---|---|
| 1,158,208 | 10/1915 | Hart | 2/22 |
| 1,184,868 | 5/1916 | Pierce | 2/22 |
| 1,647,452 | 11/1927 | Knischewsky . | |
| 2,649,989 | 6/1953 | Woodward . | |
| 3,259,910 | 7/1966 | Daignault . | |
| 3,653,690 | 4/1972 | Traueller . | |
| 3,877,077 | 4/1975 | Chapdelaine | 2/22 |
| 3,898,697 | 8/1975 | Whitehead . | |
| 4,422,183 | 12/1983 | Landi . | |

*Primary Examiner*—Ronald Feldbaum
*Attorney, Agent, or Firm*—Nixon & Vanderhye

[57] ABSTRACT

The disclosure herein describes a goal-keeper pad which comprises a heavily padded body defining an upper thigh section, an intermediate leg section and a lower foot section. The outer coverings in the lower rear areas of the leg section and of the foot section have cut-out portions which are covered with an accordion-like joint sewn to the coverings. The joint is formed of an arrangement of bands and pieces of material interconnected and folded together by sewing, the band material being stretchable, the pieces of material being highly resistant.

6 Claims, 4 Drawing Figures

FIG. 2
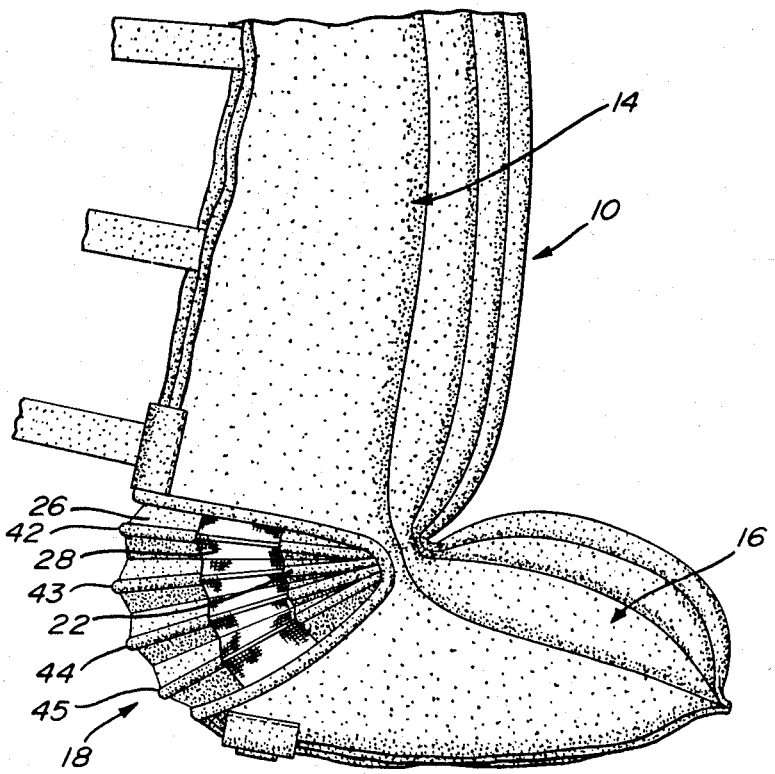
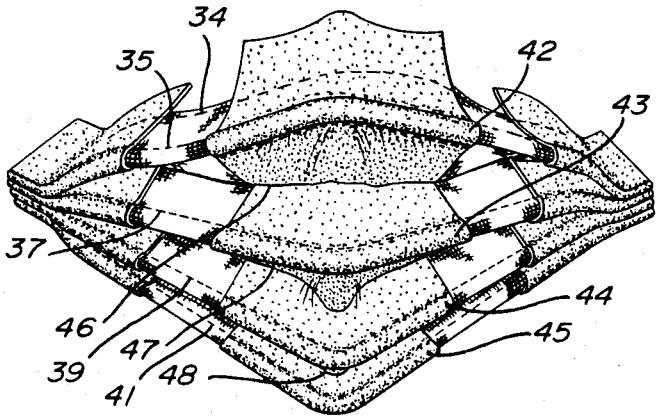
FIG. 4

GOAL-KEEPER PAD

FIELD OF THE INVENTION

The present invention pertains to the construction of a goal-keeper pad especially designed for hockey players; however, the invention is also applicable to pads used by other sports players.

BACKGROUND OF THE INVENTION

One example of a goal-keeper pad is shown described in U.S. Pat. No. 1,647,452 issued Nov. 1, 1927 to Knischewsky. Such pad mainly consists of a heavily padded body that includes an upper thigh section and a lower leg section. More recently, goal-keeper pads have been made with a further lower section, called foot section, which extends over a major portion of the goal-keeper skate for protection. While relative movement between the thigh section and the leg section has principally been accomplished by the provision of transverse ribs in the knee area of the pad, no such movement is provided at the foot section which is usually constructed integral with the leg section with a slight downward and forward inclination relative to the plane of the leg section. Hence, there is a lack of flexibility between the leg section and the foot section to follow the relative angular positions of the leg and foot of the goaler during the game of hockey.

OBJECTS AND STATEMENTS OF THE INVENTION

It is therefore an object of the present invention to provide a goal-keeper pad whereby ease of movement between the foot section relative to the leg section is permitted when the pad is used during the practice of a sport.

This object is achieved by providing ,in the lower rear area of the leg section and of the foot section, an accordion-like joint allowing these two sections to move relative to one another.

The present invention therefore relates to a goal-keeper pad, which comprises:

(a) a heavily padded body including (i) an upper thigh section;

(ii) an intermediate leg section; and (iii) a lower foot section;

the sections having front, rear and side outer coverings; the coverings defining cut-out portions in the lower rear area of the leg section and the rear area of the foot section;

(b) an accordion-like joint sewn in covering arrangement to the cut-out portions and being formed of:

(i) a pair of opposite outer bands of stretchable material;

(ii) an intermediate arrangement of pieces of resistant material disposed between the pair of bands; and (iii) a third band of stretchable material centrally disposed on the intermediate arrangement; the bands and pieces of material being folded and sewn together to form the joint.

In preferred forms of the invention, the joint is formed of an arrangement of ballistic nylon material as the high resistant material and of leather for the stretchable material.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 2 is an enlarged fragmentary side elevational view of the lower part of the goal-keeper pad shown in FIG. 1;

FIG. 1, is an illustrative plan view of the joint showing, from the inside, the arrangement of bands and pieces of material; and FIG. 4 is a perspective view of the joint with the bands and pieces sewn and folded together.

DESCRIPTION OF PREFERRED EMBODIMENTS

Figure 1:
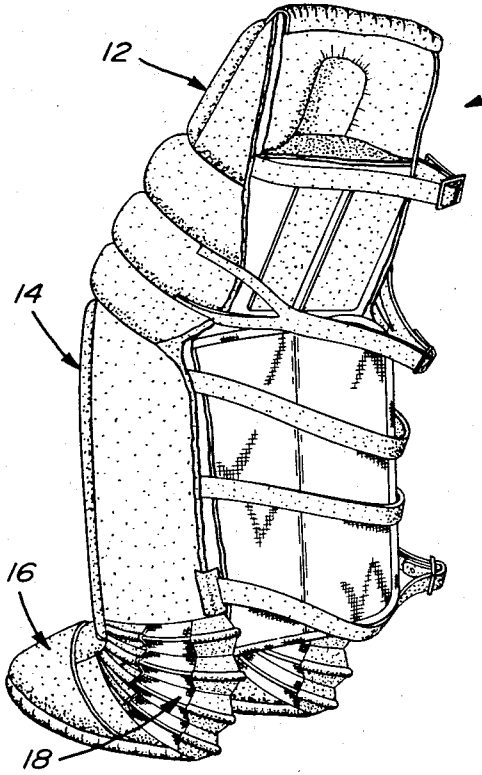
FIG. 1 is a perspective view showing the rear of a goal-keeper pad made in accordance with the present invention.

Referring to FIGS. 1 and 2, there is shown a goal keeper pad, generally denoted 10, consisting principally of three sections: an upper thigh section 12, an intermediate leg section 14 and a lower foot section 16. Body 10 is heavily padded and formed of any suitable padding material such as foam plastic, foam rubber, etc. enclosed in a plurality of outer coverings of leather, plastic or other flexible and scuff resistant material. Hence, these outer coverings are found on the front, rear and side surfaces of the three above-mentioned sections of the pad.

The particular construction of the interior of the pad is not part of the present invention, nor of its outer coverings except that a pair of cut-out portions are defined in the coverings at the lower rear junction of the leg section with the foot section. These cut-out sections are however covered with an accordian-like joint 18 which is the main feature of the present invention. This joint 18 is sewn to the adjacent coverings of the leg and foot sections of the pad.

Figure 3:
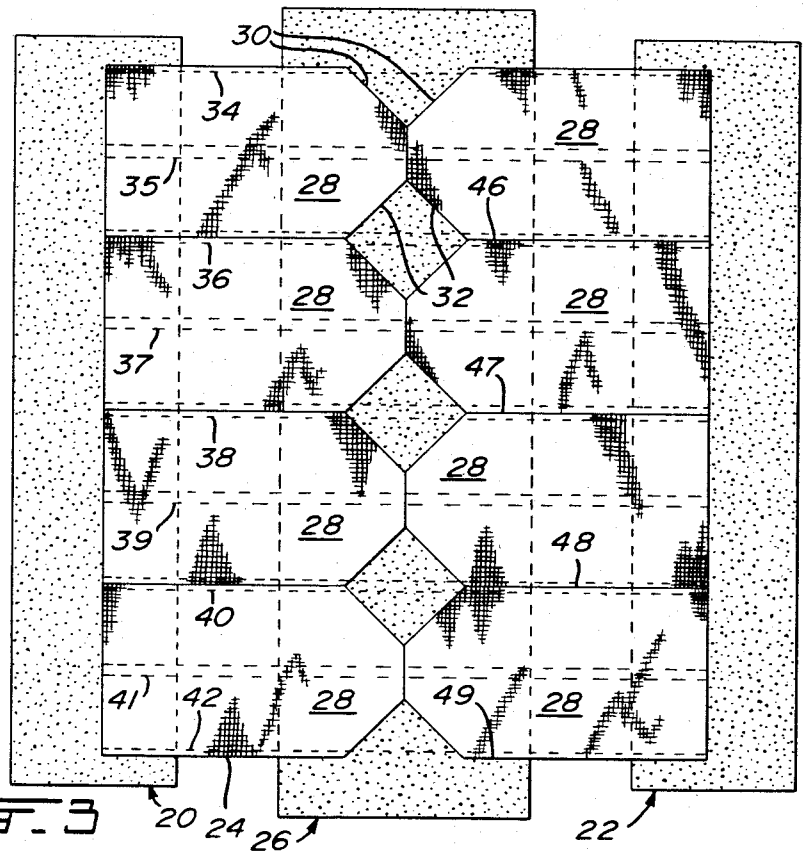
FIG. 3, which is represented on the sheet showing

Referring more particularly to FIG. 3, the joint consists of an arrangement of bands and pieces of material that include a first pair of opposite outer bands 20 and 22 of stretchable material, an intermediate composite arrangement of pieces of highly resistant material 24, and a third band 26 of stretchable material centrally extending over the intermediate arrangement 24.

The composite arrangement 24 is formed of a series of identical pieces of material 28 which have a generally rectangular shape, except for one edge which has upper and lower chamfered corners 30 and 32. The pieces are arranged in pairs and in a vertical arrangement.

FIG. 3 gives a layout in plan view of the various bands and pieces making up the accordion-like joint. Sewing lines 34, 35, 36, 37, 38, 39, 40, 41 and 42 indicate how the bands and pieces are connected together to form a single element. Lines 35, 36, 37, 38, 39, 40 and 41 are doubles but represent a single sewing line; the area between the lines defines an inner or an outer fold. Referring to FIG. 4, double lines 35, 37, 39, 41 define the outer folds 42, 43, 44, 45 respectively while double lines 36, 38, 40 define the inner folds 46, 47, 48 respectively. The chamfered corners 32 of the pieces 28 define a diamond-shaped opening. This allows the accordian-like joint to adopt a V-shaped configuration such as shown in FIG. 4 when the joint is unfolded.

It has been found that a highly resistant material for the composite sheet 24 is ballistic nylon (trademark). On the other hand, leather has been found extremely satisfactory for providing the stretchability required for the joint.

As illustrated in FIG. 1, the pad also includes a series of straps 44 and buckles 46 at the rear of the leg and thigh sections at spaced intervals along the junction of the rear and side coverings. However, no straps are connected to the joint.

Although the invention has been described above in relation to one specific form, it is evident that it may be refined and modified in various ways. It is therefore wished to have it understood that the present invention should not be limited in interpretation except by the terms of the following claims.

The embodiments of the invention in which an exclusive property or privilege is claimed are defined as follows:

1. A goal keeper pad comprising:

(a) a heavily padded body, including:

(i) an upper thigh section;

(ii) an intermediate leg section; and (iii) a lower foot section;

said sections having front, rear and side outer coverings; said coverings defining cut-out portions in a lower rear area of the leg section and the rear area of the foot section;

(b) an accordion-like joint sewn in covering arrangement to said cut-out portions, said joint being formed of:

(i) a pair of opposite outer bands of stretchable material;

(ii) an intermediate arrangement of pieces of resistant material disposed between said pair of bands; and (iii) a third band of stretchable material centrally disposed on said intermediate arrangement; said bands and pieces being folded and sewn together to form said accordion-like joint.

2. A goal-keeper pad as defined in claim 1, wherein said pieces are made of ballistic nylon material.

3. A goal-keeper pad as defined in claim 1, wherein said bands are made of leather.

4. A goal-keeper pad as defined in claim 2, wherein said arrangement is formed of a series of identically-shaped pieces arranged vertically in facing pairs.

5. A goal-keeper pad as defined in claim 4, wherein each piece has a generally rectangular shape with the border thereof facing that of the piece of its pair having its upper and lower corner chamfered.

6. A goal-keeper pad as defined in claim 1, further comprising a plurality of straps extending over the thigh and leg sections at the rear thereof and having the opposite ends thereof secured at spaced vertical intervals, except in the area of said joint, to rear joining edges of the rear and side coverings.

* * * * *